United States Patent [19]

Enright

[11] 4,012,900

[45] Mar. 22, 1977

[54] SETTING MEANS FOR ESTIMATED TIME OF ARRIVAL CLOCK HANDS

[75] Inventor: Wayne Jay Enright, Delavan, Wis.

[73] Assignee: Bunker Ramo Corporation, Oak Brook, Ill.

[22] Filed: Jan. 12, 1976

[21] Appl. No.: 648,536

[52] U.S. Cl. ..... 58/126 D; 58/152 G; 58/85.5

[51] Int. Cl.[2] ..... G04B 19/28; G04B 47/06

[58] Field of Search ..... 58/5, 42.5, 85.5, 126 R, 58/126 D, 152 R, 152 G

[56] References Cited

UNITED STATES PATENTS

| | | | |
|---|---|---|---|
| 267,824 | 11/1882 | Bell | 58/126 D |
| 1,790,359 | 1/1931 | Weir | 58/152 G |
| 2,645,077 | 7/1953 | Olson | 58/85.5 |
| 3,837,161 | 9/1974 | Wuthrich | 58/42.5 |

*Primary Examiner*—Stanley J. Witkowski
*Attorney, Agent, or Firm*—Hill, Gross, Simpson, Van Santen, Steadman, Chiara & Simpson

[57] ABSTRACT

A clock for indicating estimated time of arrival has a minute hand and hour hand for indicating present time in combination with a minute and hour hand which are set for estimated time of arrival (ETA). An ETA hour hand knob positioned above the crystal on the face of the clock has a hollow shaft which protrudes through a central aperture in the clock crystal. The ETA hour hand is mounted to the shaft and mounting tension for the hour hand knob is maintained by a spring washer between the ETA hour hand and clock crystal. An ETA minute hand knob has a shaft portion which coaxially protrudes through the hollow shaft of the hour hand knob. An ETA minute hand is securely fastened to the end of the minute hand knob shaft. A second spring washer is provided between a shoulder on the ETA minute hand knob and a top portion of the hour hand knob, the entire combination providing a simple, stable, individually settable ETA hour and minute hand set.

7 Claims, 2 Drawing Figures

SETTING MEANS FOR ESTIMATED TIME OF ARRIVAL CLOCK HANDS

BACKGROUND OF THE INVENTION

1. Field of the Invention

This invention relates to clocks and more particularly to a setting mechanism for estimated time of arrival clock hands.

2. Prior Art

It has been known to provide an extra set of minute and hour hands on a clock which may be manually set for an estimated time of arrival (ETA) at a particular destination. Such a mechanism is particularly useful in an automobile or aircraft clock in which the hands can be set to a predetermined time up to 12 hours in the future on a 12-hour clock, or up to 24 hours on a 24 hour clock. The actual time indicated can be readily compared to the ETA at a particular destination. Previous clocks having ETA hands have utilized means for setting ETA hour and minute hands which is awkward, inconvenient, and difficult to manufacture since large numbers of parts are involved. Since ETA clocks are most useful in moving vehicles, it is important that the operator be able to quickly set the ETA hour and minute hands without being distracted from operation of the vehicle, and that once set, the ETA setting is vibration resistant.

United States Letters Patent No. 1,790,359 to Weir illustrates one example of a prior art ETA clock having the above described disadvantages. Weir discloses an ETA minute hand and ETA hour hand provided in addition to the normal minute and hour hands for indicating present time. A single knob is positioned on the front of the clock crystal which directly drives or controls the ETA minute hand. The ETA hour hand, however, is coupled to the minute hand by a reduction gear. Therefore, the knob in Weir must be rotated one complete revolution for each hour change. Therefore, in the case of 12-hour clock, up to six revolutions may be required to set the minute and hour hands, assuming bi-directional knob rotation.

In United States Letters Patent No. 3,837,161 to Wuthrich, a regular and an auxiliary hour hand rotate together in one direction and rotate relative to one another in the opposite direction. Such an arrangement is inappropriate for an ETA clock setting since, once set, the ETA hands remain stationary.

United States Letters Patent No. 2,645,077 to Olson describes the use of two knobs aligned in coaxial fashion which can be locked together in common rotation by insertion of a tool. Use of such a tool would be inconvenient for one wishing to set ETA time rapidly.

The Wakmann Watch Company has marketed clocks providing ETA hour and minute hands. However, in the Wakmann devices known to me, a single knob is employed and sets the ETA hour hand via a gear reduction, as in Weir, or via a one-way clutch which sets the ETA hour hand by counterclockwise rotation and the ETA minute hand by clockwise rotation whereby an accidential overshoot in setting either hand makes proper reverse setting annoying to the operator.

SUMMARY OF THE INVENTION

A clock for indicating estimated time of arrival is provided herein which is convenient to set and simple to manufacture and in which independent control at the hour and minute hands is achieved using a minimum number of components. An ETA hour hand knob having a hollow shaft portion is positioned within an aperture of the crystal on the front of the clock. An ETA hour hand is secured to the shaft and a first spring washer of predetermined tension is positioned between the ETA hour hand and the clock crystal. An ETA minute hand having a shaft portion is coaxially received within the hollow portion of the hour hand knob. A second spring washed is positioned between a shoulder on the minute hand knob and a recess in the top of the hour hand knob. The tension of the second spring washer is less than the tension of the first spring washed to permit rotation of the minute hand knob without disturbing the setting of the hour hand knob. However, since the minute hand knob is secured to the hour hand knob, when the hour hand knob is rotated, both the hour and minute hands rotate in unison. Therefore, the hour hand may initially be set with less than a full rotation of the hour hand knob. Thereafter, the minute hand can be quickly adjusted in either direction without disturbing the hour hand setting.

It is an object of this invention to provide a mechanism for setting ETA hour and minute hands rapidly with a minimum of knob rotations.

It is a further object of this invention to provide dual knobs arranged coaxially for adjusting an ETA hour hand and later independently adjusting an ETA minute hand.

It is another object of this invention to provide a setting means for ETA clock hands having a minimum number of parts which are adapted for rapid and inexpensive assembly.

Other objects, features and advantages of the present invention will be apparent from the following description taken in conjunction with the accompanying drawings.

DESCRIPTION OF THE PREFERRED EMBODIMENTS

Figure 1:
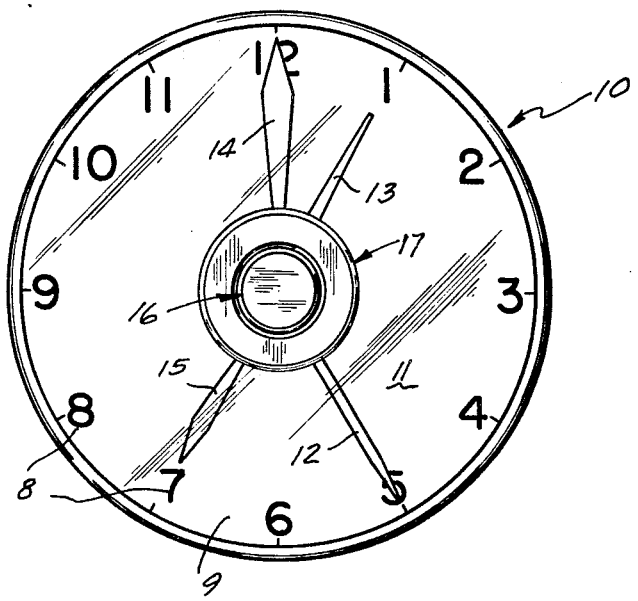
FIG. 1 is a plan view of the front of a clock having present time minute and hour hands together with ETA minute and hour hands having a time setting means according to this invention.

The principles of the present invention are particularly useful when embodied in a clock, shown generally by numeral 10 of FIG. 1, for indicating present and estimated time of arrival (ETA). A clock crystal 11 is positioned over a clock face 9 having numerals 8. A current time minute hand 12 and current time hour hand 13 are provided for indicating current time. The ETA minute hand 14 and ETA hour hand 15 are respectively controlled by the ETA minute hand knob 16 and ETA hour hand knob 17 to which they are respectively rigidly attached in any convenient manner, such as by staking. The clock crystal 11 provides a fixed structural mounting surface for the knobs 16, 17 and hands 14, 15.

Figure 2:
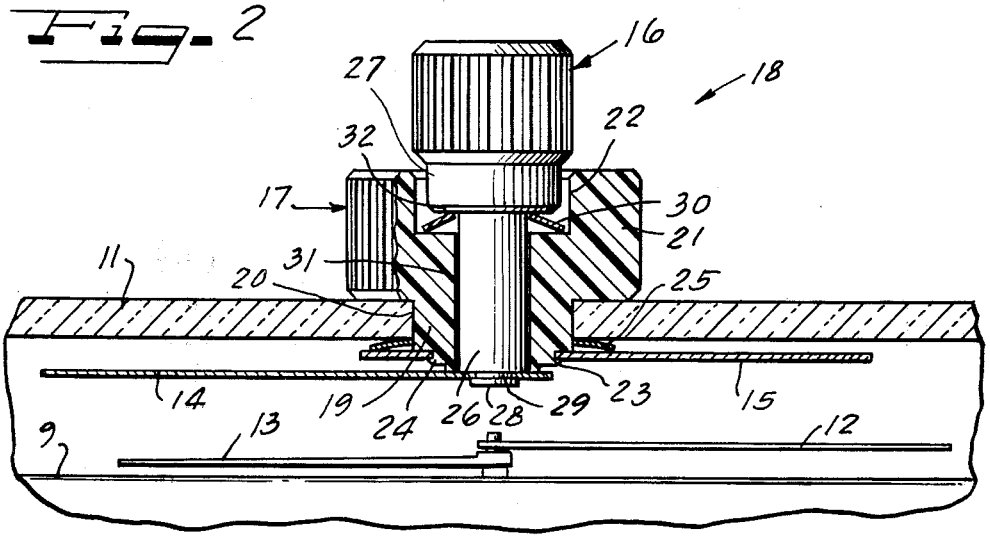
FIG. 2 is an enlarged side cross-sectional view of the ETA minute and hour hand setting mechanism of this invention.

In FIG. 2, setting mechanism 18 is generally illustrated which permits simple adjustment of the ETA minute and hour hands 14 and 15 by use of a minimum number of components which are easily assembled. The ETA hour hand knob 17 is provided with a hollow shaft portion 19, a main body portion 21 of larger diameter, and an inner recess 22. The hollow shaft portion 19 has an aperture 31 therein through which an ETA minute hand knob shaft 26 is coaxially inserted.

The shaft portion 19 of the ETA hour hand knob 17 projects through an aperture 20 in the crystal 11. The ETA hour hand 15 is securely fastened to the hour hand knob 17 by the staked or spun-over shoulder 23 on a reduced diameter portion 24 of the hour hand shaft portion 19. A first spring washer 25 of predetermined tension surrounds the shaft portion 19 and is retained between the hour hand 15 and crystal 11 to maintain sufficient tension to frictionally retain the hour hand knob 17 stationary when the minute hand knob 16 is rotated.

The ETA minute hand knob 16 has a shaft portion 26 and a main body portion 27 of larger diameter. As above noted, the shaft portion 26 coaxially projects through the aperture 31 of the hour hand knob 17. The main body portion 17 partially extends into the recess 22 at the top of the hour hand knob 17. A second spring washer 30 of a predetermined lesser tension surrounds the shaft portion 26 and rests in contact between the bottom of the recess 22 and a shoulder 32 created at the transition from the main body 27 to the shaft portion 26 of the ETA minute hand 16. The tension exerted by second spring washer 30 is sufficient to maintain the minute hand 14 in position against vibration yet weak enough to permit rotation of the ETA minute hand knob 16 without disturbing the setting of the hour hand knob 17.

ETA minute hand 14 is securely fastened to the shaft portion 26 of the minute hand knob 16 by a staked or spun-over shoulder 28 which secures the minute hand 14 to a reduced diameter portion 29 of the shaft portion 26.

In operation, the ETA hour hand knob 17 is rotated in either direction to position the hour hand 15 as desired. Since the minute hand knob 16 rotates independently of the hour hand knob 17, the previously positioned hour hand remains unchanged.

Assembly of the apparatus of this invention is both rapid and inexpensive. The hour hand knob 17 is inserted through the aperture 20 in the crystal 11, first spring washer 25 is installed through the aperture 20 in the crystal 11, first spring washer 25 is installed over the shaft portion 19, and the hour hand 15 is fastened securely in place by spinning or staking shoulder 23. Spring washer 30 is positioned around the shaft portion 26 of the minute hand knob 16 and the shaft 26 is coaxially inserted 31 of the hour hand knob 17. Finally, the minute hand 14 locks the minute hand knob 16 in the hour hand knob aperture 31 when it is fastened to the shaft 26 by shoulder 28.

Certain variations on the design illustrated in FIG. 2 are obvious. Diameters of the ETA minute hand knob 16 and hour hand knob 17 may be of the same order. The recess 22 may be eliminated or placed within the minute knob in reverse fashion. Also, the spring 30 may act between cylindrical surfaces 22 and 16 and comprise a rubber O-ring or other friction like means. Although various other modifications may be suggested to those versed in the art, it should be understood that I wish to embody within the scope of the patent warranted hereon, all such embodiments as reasonably and properly come within the scope of the hereinafter appended claim.

I claim as my invention:

1. A method for setting estimated time of arrival (ETA) minute and hour hands comprising steps of:

a. rotating an ETA hour hand knob less than one-half revolution to set an ETA hour hand; and b. rotating a minute hand knob less than one-half revolution to set an ETA minute hand without disturbing the ETA hour hand setting.

2. A time setting apparatus adapted for positioning estimated time of arrival (ETA) minute and hour hands on a current time clock having current hour and minute hands, comprising:

a. fixed clock structural means forwardly of said clock hands and having an aperture therein coaxial with the axis of rotation of the current time hands for mounting ETA minute and hour hands thereto;

b. an ETA hour hand knob having an aperture therethrough retained in said clock structural means aperture for bi-directional frictionally retarded rotation therein;

c. an ETA hour hand rigidly secured to said hour hand knob;

d. an ETA minute hand knob retained on said hour hand knob for bi-directional frictionally retarded rotation with respect thereto, and e. an ETA minute hand fastened to said minute hand knob.

3. A time setting apparatus adapted for positioning estimated time of arrival (ETA) minute and hour hands on a clock, comprising:

a. a clock crystal with an aperture therein;

b. an ETA hour hand knob having a main body portion and a hollow, reduced diameter shaft portion positioned in said aperture;

c. an ETA hour hand fastened to an end of said hour hand knob shaft portion;

d. first tension means positioned between said hour hand and clock crystal;

e. an ETA minute hand knob having a main body portion and a reduced diameter shaft portion positioned within said hour hand knob hollow shaft portion;

f. an ETA minute hand fastened to said minute hand knob shaft portion; and g. second tension means positioned between said hour hand knob and said minute hand knob, said second tension means exerting less frictional force than said first tension means.

4. The time setting apparatus of claim 3 in which said hour hand knob has an inner recess for receiving said second tension means and a portion of said ETA minute hand knob and wherein said second tension means is positioned.

5. The time setting apparatus of claim 3 in which said first tension means is an annular axially compressible spring washer.

6. The time setting apparatus of claim 3 in which said ETA minute hand knob has a smaller diameter than said hour hand knob diameter.

7. The time setting apparatus of claim 3 in which the connection of the hour and minute hands to the respective shaft portions of the hour and minute hand knobs is provided by use of staked shoulders on a reduced diameter portion of each of said shaft portions.

* * * * *